US009880513B2

(12) United States Patent
Ishida et al.

(10) Patent No.: US 9,880,513 B2
(45) Date of Patent: Jan. 30, 2018

(54) IMAGE FORMING APPARATUS INCLUDING COVER OPENING AND CLOSING MECHANISM

(71) Applicant: KYOCERA Document Solutions Inc., Osaka (JP)

(72) Inventors: Hirotaka Ishida, Osaka (JP); Shinji Furuta, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 15/604,790

(22) Filed: May 25, 2017

(65) Prior Publication Data

US 2017/0343956 A1 Nov. 30, 2017

(30) Foreign Application Priority Data

May 31, 2016 (JP) ..... 2016-109250

(51) Int. Cl.
*G03G 21/16* (2006.01)

(52) U.S. Cl.
CPC ..... *G03G 21/1633* (2013.01)

(58) Field of Classification Search
CPC .. G03G 21/1633; G03G 21/1666; H01H 3/12; H01H 13/14; H01H 5/00
See application file for complete search history.

(56) References Cited

U.S. PATENT DOCUMENTS

2008/0308398 A1* 12/2008 Ito ..... B41J 29/02 200/520
2011/0305480 A1* 12/2011 Tanaami ..... G03G 15/0147 399/112
2013/0136491 A1* 5/2013 Fumoto ..... G03G 21/1633 399/110

FOREIGN PATENT DOCUMENTS

CN 2462603 Y * 11/2001
CN 104658788 A * 5/2015
JP 2008-310151 12/2008

* cited by examiner

*Primary Examiner* — Francis Gray
(74) *Attorney, Agent, or Firm* — Wenderoth, Lind & Ponack, L.L.P.

(57) ABSTRACT

In an image forming apparatus provided with a cover opening and closing mechanism, a cover opening and closing mechanism includes a button, an operating pin, and a belt-like elastic body that takes a first posture and a second posture, both of which have shape stability, by a snap-through buckling phenomenon. The belt-like elastic body takes the first posture in a state in which the cover has been closed and prevents the operating pin from being pressed to a side of the image forming apparatus body, and is pushed by a pushing operation of the button to take the second posture, operates the operating pin to be pressed to the side of the image forming apparatus body, and opens the cover by reaction force thereof.

3 Claims, 9 Drawing Sheets

IMAGE FORMING APPARATUS INCLUDING COVER OPENING AND CLOSING MECHANISM

CROSS-REFERENCE TO RELATED APPLICATION

This application is based upon and claims the benefit of priority from Japanese Patent Application No. 2016-109250 filed on May 31, 2016, the entire contents of which are incorporated herein by reference.

BACKGROUND

The technology of the present disclosure relates to an image forming apparatus including a cover opening and closing mechanism.

Conventionally, an image forming apparatus including a cover opening and closing mechanism as illustrated in FIG. 8 to FIG. 11, has been proposed.

In this image forming apparatus, a button 7 having a protrusion 7*a* with a sharpened distal end is supported to a cover 6 so as to be rotatable about a shaft 8. The button 7 is always urged outward (upward in FIG. 8) by a spring 9. As illustrated in FIG. 8, in the state in which the cover 6 is closed, since a locking stepped portion 7*b* is engaged with a peripheral edge of a hole 6*a* of the cover 6, the button 7 maintains the illustrated posture. At a rear surface of the cover 6, a fixed hook 10 is fixed.

At an image forming apparatus body 2 side, a movable hook having engaging surfaces 11*a* and 11*b* forming a stepwise shape is supported so as to be rotatable about a shaft 12. The movable hook 11 is always urged to the button 7 side (a right side in FIG. 8) by a spring 13. As illustrated in FIG. 8, in the state in which the cover 6 is closed, since the engaging surface 11*a* is engaged with the protrusion 7*a* of the button 7, the movable hook 11 maintains the illustrated posture. In this case, since the movable hook 11 is engaged with the fixed hook 10 of the cover 6 side, the closed state of the cover 6 is locked, so that it is not possible to open the cover 6 in this state.

In order to open the cover 6 from the closed state of FIG. 8, the button 7 is pushed against the urging force of the spring 9. As illustrated in FIG. 9 and FIG. 10, the button 7 is rotated about the shaft 8 in a direction (a clockwise direction) indicated by an arrow a, and the distal end portion of the protrusion 7*a* abuts the engaging surface 11*a* of the movable hook 11, so that the movable hook 11 is rotated about a shaft 12 in a direction (a counterclockwise direction) indicated by an arrow b against the urging force of the spring 13. Therefore, the movable hook 11 is detached from the fixed hook 10 and engagement of both hooks is released, so that the locking of the cover 6 is also released.

When a hand is released from the button 7 in the state of FIG. 10, the cover 6 is kicked out outward (upward in FIG. 11) by the urging force of the spring 9 as illustrated in FIG. 11. By applying the hand to the kicked-out cover 6 and rotating the cover 6, it is possible to open the cover 6. In this case, the movable hook 11 is rotated about the shaft 12 in a direction (a clockwise direction) indicated by an arrow c of FIG. 11 by the urging force of the spring 13 and returns to the original position. However, as described above, since the cover 6 is kicked out and the fixed hook 10 is accordingly moved outward, the movable hook 11 is not engaged with the fixed hook 10.

On the other hand, in order to close the cover 6 from the opened state of FIG. 11, the cover 6 is pushed in as is. By so doing, the fixed hook 10 abuts the movable hook 11 to push the movable hook 11, so that the cover 6 is closed. When the cover 6 is completely closed, the abutting of the fixed hook 10 and the movable hook 11 is released, so that the movable hook 11 is rotated by the urging force of the spring 13 and is engaged with the fixed hook 10. Therefore, as illustrated in FIG. 8, the closed state of the cover 6 is locked.

SUMMARY

An image forming apparatus according to the technology of the present disclosure includes an image forming apparatus body, a cover, and a cover opening and closing mechanism. The cover is provided to the image forming apparatus body so as to be openable and closable. The cover opening and closing mechanism is provided to the cover side. The cover opening and closing mechanism includes a button, an operating pin, and a belt-like elastic body. The belt-like elastic body takes a first posture and a second posture, both of which have shape stability, by a snap-through buckling phenomenon. In a state in which the aforementioned cover has been closed, the aforementioned belt-like elastic body takes the first posture to prevent the aforementioned operating pin from being pressed to the aforementioned image forming apparatus body side. On the other hand, the belt-like elastic body is pushed by a pushing operation of the aforementioned button to take the second posture, operates the aforementioned operating pin to be pressed to the aforementioned image forming apparatus body side, and opens the aforementioned cover by reaction force thereof.

DETAILED DESCRIPTION

Hereinafter, an example of an embodiment according to the technology of the present disclosure will be described in detail on the basis of the drawings. It is noted that the technology of the present disclosure is not limited to the following embodiments.

Figure 1:
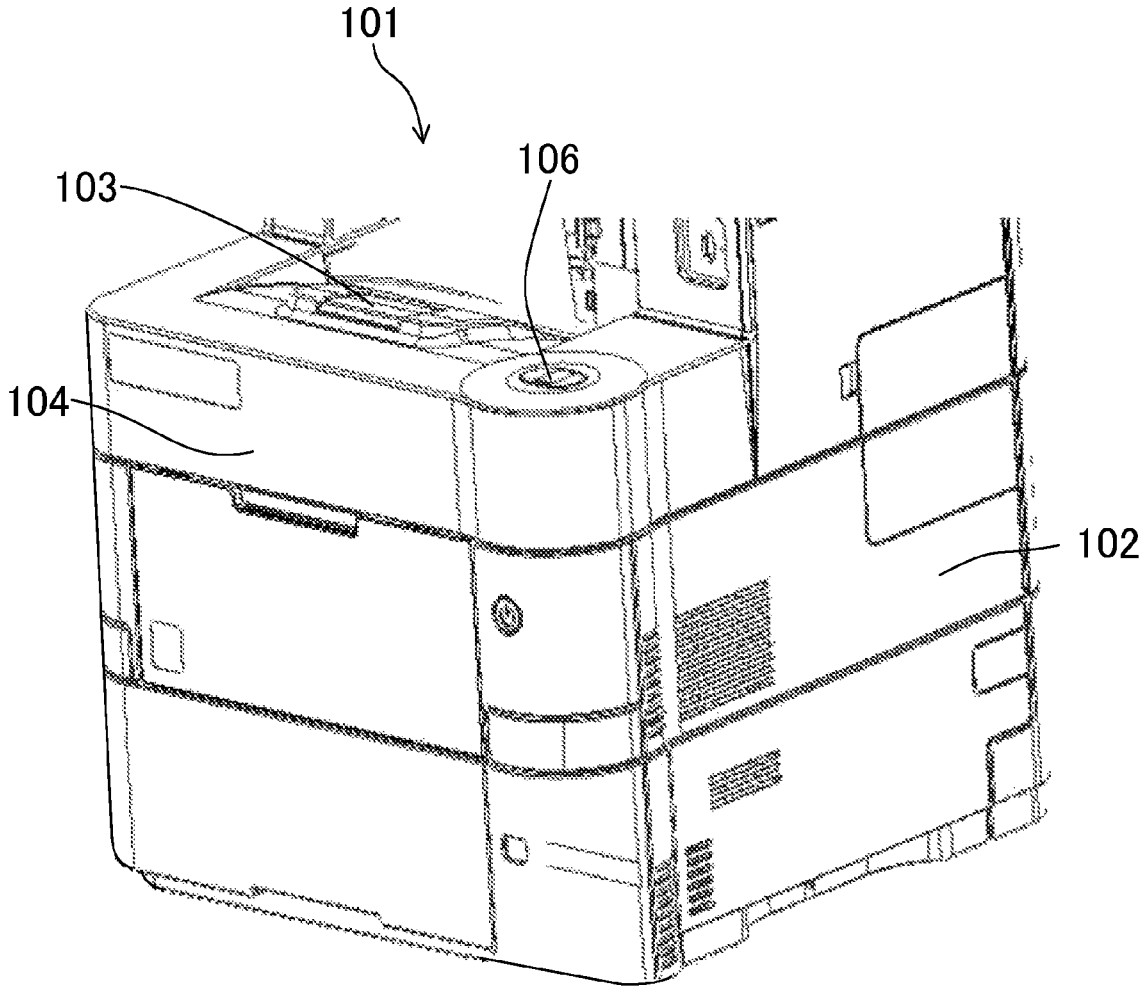
FIG. 1 is a perspective view of an image forming apparatus according to one example of an embodiment.
Figure 2:
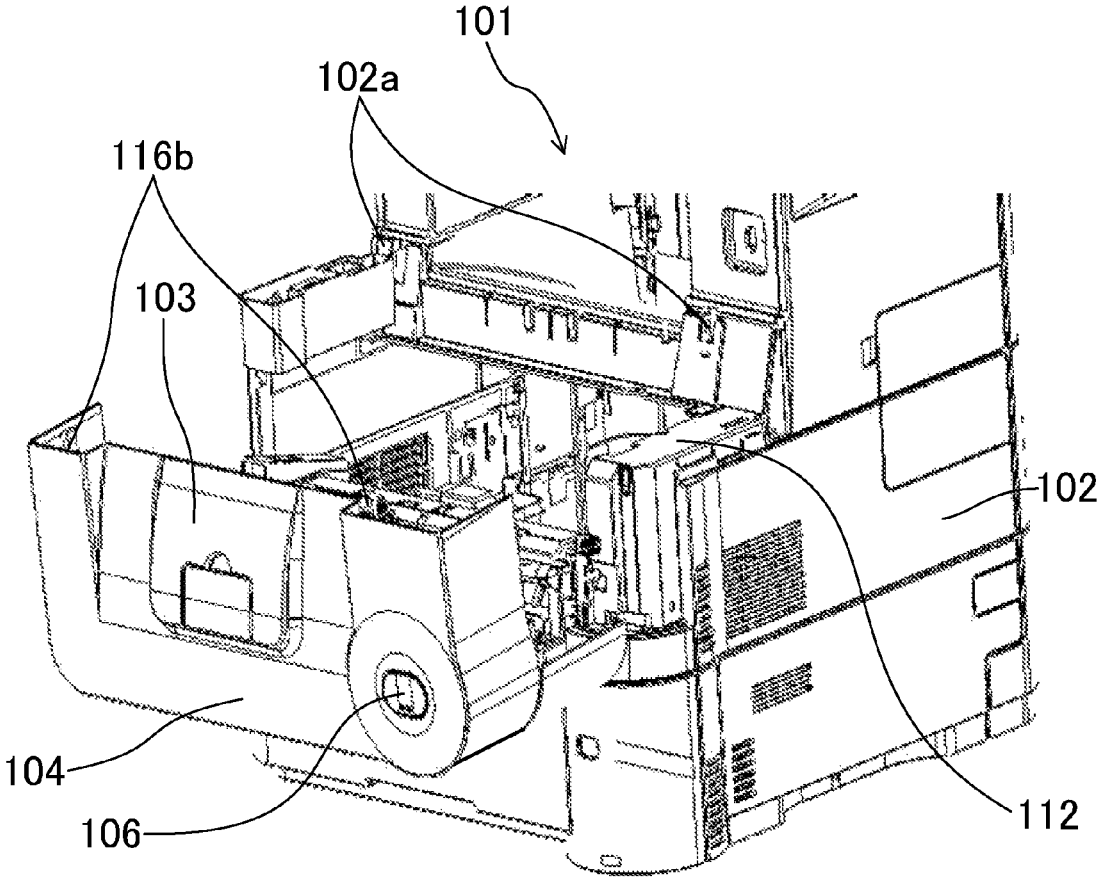
FIG. 2 is a perspective view illustrating a state in which a cover of an image forming apparatus according to one example of an embodiment is opened.

FIG. 1 is a perspective view of an image forming apparatus according to one example of an embodiment, and FIG. 2 is a perspective view illustrating a state in which a cover of the image forming apparatus is opened.

In FIG. 1 and FIG. 2, an image forming apparatus 101 includes a rectangular image forming apparatus body 102, wherein above the image forming apparatus body 102, a paper discharge tray 103 is provided. The paper discharge tray 103 is configured with a part of a downward opening type cover 104 of the image forming apparatus body 102, wherein the cover 104 is provided to the image forming apparatus body 102 so as to be openable and closable.

The image forming apparatus body 102 is provided therein with various process equipments such as a photosensitive drum, a charging device, an exposing device, a developing device, a transfer device, and a fixing device (all are not illustrated).

At the cover 104 side, a cover opening and closing mechanism 105 is provided. The cover opening and closing mechanism 105 includes a button 106, an operating pin 107, a belt-like elastic body 108, a lock mechanism 116, and an interlocking mechanism (not illustrated) that interlocks the lock mechanism 116 with the button 106.

The button 106 is a push-button type, and is provided such that a head part 106*a* is exposed to an upper surface of the cover 104 installed at a side of the paper discharge tray 103. As illustrated in FIG. 4 to FIG. 7, a guide pin 106*b* and a pair of pressing pieces 106*c* are vertically provided at a lower surface of the head part 106*a*. The guide pin 106*b* is movably inserted into a first guide tube 110, which protrudes toward a cover space S from an inner surface of a back plate 109 of the cover 104, so as not to vibrate laterally.

Figure 3:
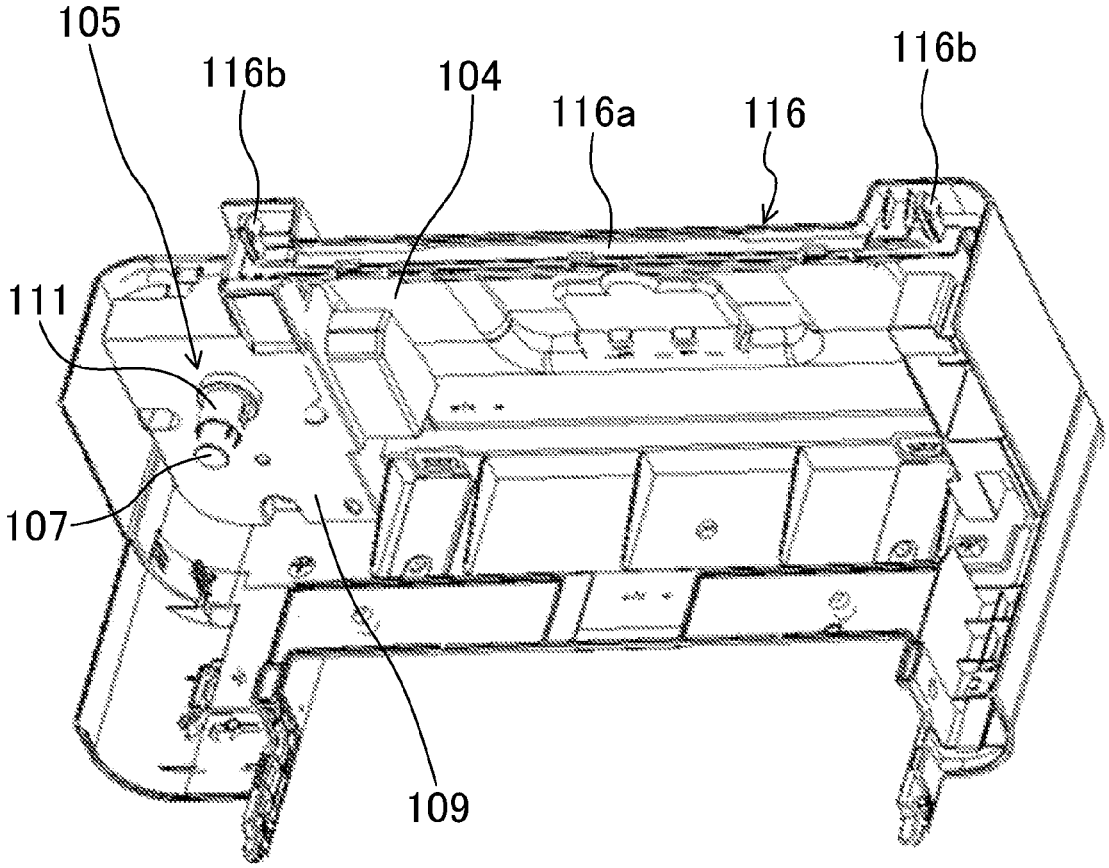
FIG. 3 is a perspective view illustrating a state in which a cover of an image forming apparatus according to one example of an embodiment is turned inside out.

As also illustrated in FIG. 3, from an outer surface of the back plate 109, a second guide tube 111 protrudes away from the first guide tube 110. The cover space S is continuous to the outer side of the back plate 109 via the second guide tube 111. The operating pin 107 passes through the second guide tube 111 and is movably supported by the second guide tube 111. A lower end of the operating pin 107 faces an abutting part 112 of the image forming apparatus body 102 side.

The belt-like elastic body 108 includes a leaf spring. The belt-like elastic body 108 is configured to take a first posture and a second posture, both of which have shape stability, by a snap-through buckling phenomenon.

The snap-through buckling (snap-through) represents a phenomenon that, when external force is simply increased, a member linearly deformed according to the external force is discontinuously deformed at once from a certain shape to another shape. That is, it occurs because a shape before and after deformation is more stable than a shape during the deformation.

The belt-like elastic body 108 is arranged such that the button 106 and the operating pin 107 are connected to each other in the cover space S. One end (a left end in FIG. 4 to FIG. 7) of the belt-like elastic body 108 is fixed to a first boss 113 protruding toward the cover space S from an inner surface of the back plate 109.

At a place of the inner surface of the back plate 109, which is close to the first guide tube 110, a second boss 114 protrudes toward the cover space S. The second boss 114 is provided at a distal end thereof with a retaining pin 115, wherein the retaining pin 115 is inserted into the other end of the belt-like elastic body 108.

Figure 4:
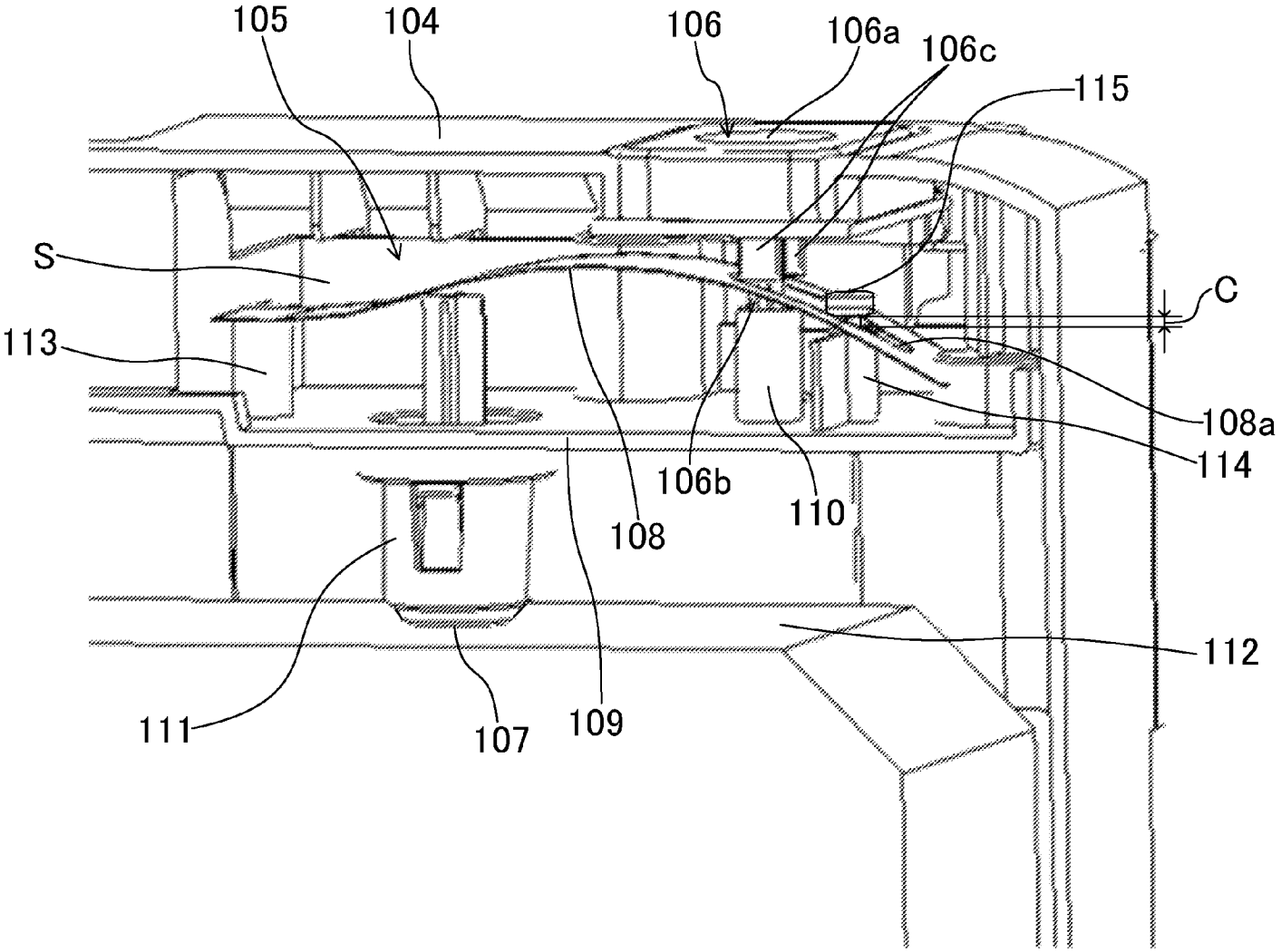
FIG. 4 is a perspective view of a cover opening and closing mechanism in a state in which a cover is closed in an image forming apparatus according to one example of an embodiment.

Near the other end (near the right end in FIG. 4 to FIG. 7) of the belt-like elastic body 108, a long hole 108*a* is formed (see FIG. 4). The guide pin 106*b* and the retaining pin 115 are inserted and fitted to the long hole 108*a* with an allowance. The belt-like elastic body 108 holds an approximately horizontal posture in the cover space S. Between the distal end of the retaining pin 115 and the distal end of the second boss 114, an interval C is formed. In this way, the other end side of the belt-like elastic body 108 is able to move in the interval C according to the deformation operation of the belt-like elastic body 108. When there is the interval C, it is possible to smoothly perform transition of the belt-like elastic body 108 between the first posture and the second posture.

Figure 5:
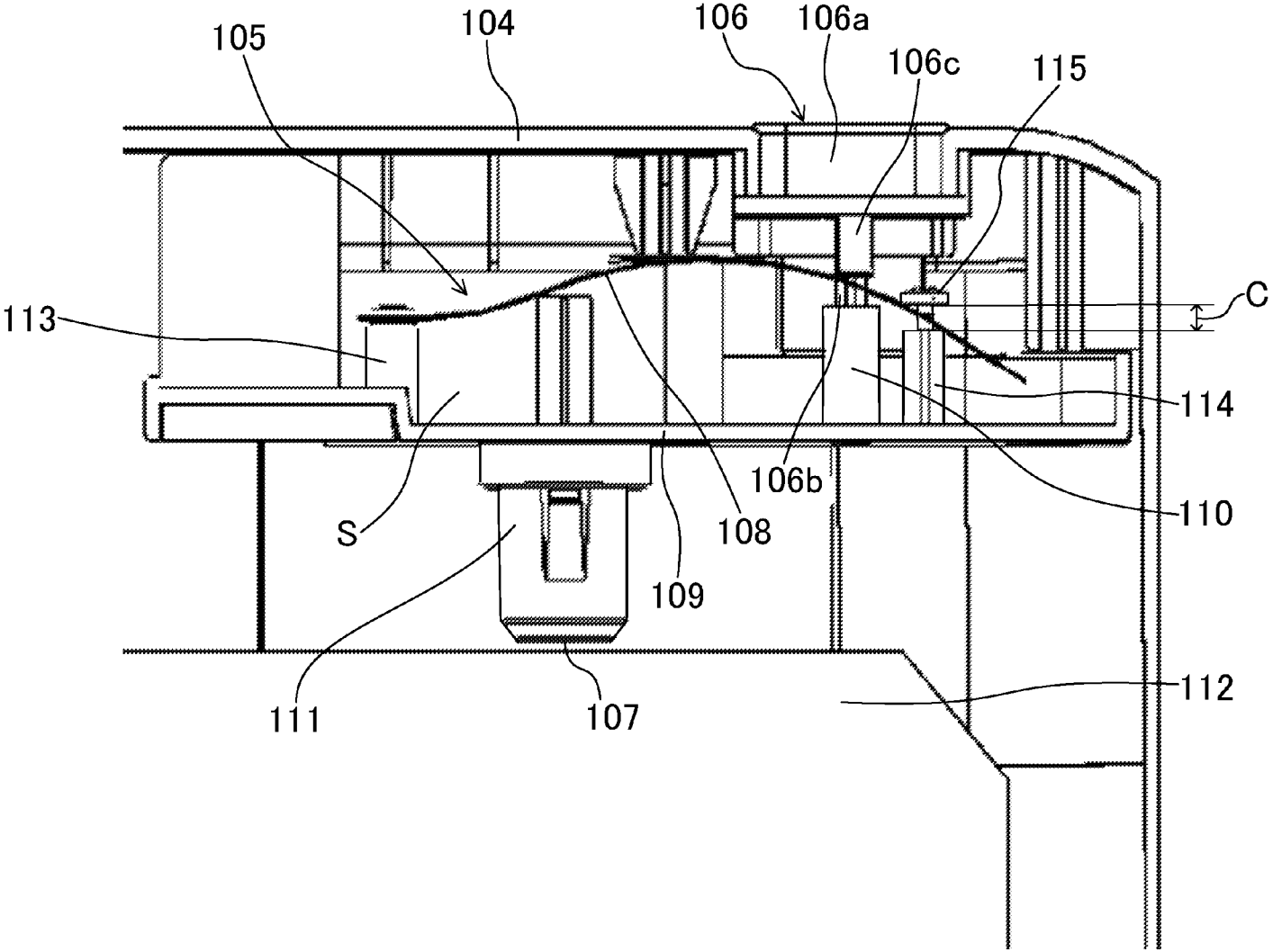
FIG. 5 is a front view of a cover opening and closing mechanism in a state in which a cover is closed in an image forming apparatus according to one example of an embodiment.

In the state of FIG. 4 and FIG. 5 in which the cover 104 has been closed, the belt-like elastic body 108 takes the first posture which has the shape stability and is curved in a bow shape so as to protrude upward. In this first posture, the pressing pieces 106*c* of the button 106 do not push the belt-like elastic body 108, so that the belt-like elastic body 108 does not push the operating pin 107. Furthermore, since a gap is formed between a lower end of the operating pin 107 and the abutting part 112 of the image forming apparatus body 102 side, the operating pin 107 does not contact with the abutting part 112. Consequently, the operating pin 107 does not operate, so that it is not pressed to the abutting part 112.

The lock mechanism 116 has a rod-like lock member 116*a* along the lower side of an end portion of the paper discharge tray 103. At both end portions of the lock member 116*a* outside the paper discharge tray 103, hook parts 116*b* are integrally formed. The lock member 116*a* is supported to the cover 104 so as to be slidable in a direction parallel to an opening and closing spindle of the cover 104. Furthermore, the lock member 116*a* is urged in the left direction in FIG. 2 by an urging means (not illustrated). A distal end portion of the hook part 116*b* has a hook nail shape. In the closed state of the cover 104, the distal end portions of the hook parts 116*b* are engaged with engaging parts 102*a* opened in a rectangular shape formed in the image forming apparatus body 102, so that the cover 104 is held in the closed state.

When the button 106 is pushed in the closed state of the cover 104, the posture of the belt-like elastic body 108 is transitioned as described above, and the lock member 116*a* is moved interlockingly in an opposite direction by the interlocking mechanism against urging force. By the interlocking movement of the lock member 116*a*, the engagement of the hook parts 116*b* and the engaging parts 102*a* is released, so that the lock state of the cover 104 and the image forming apparatus body 102 is simply released with one operation.

As with the conventional image forming apparatus described on the basis of FIG. 8 to FIG. 11 in the "background technology", in the cover opening and closing mechanism in which the cover is automatically opened by the release of the lock mechanism, since the cover always receives pressure from the inside of the image forming apparatus body in an opening direction by restoring force of the spring in the closed state, fitting failure or deformation may occur.

In order to avoid such a problem, a lock mechanism with strength exceeding the restoring force of an elastic member is required, resulting in an increase in the number of parts such as links for constituting the lock mechanism.

However, the present embodiment uses the belt-like elastic body 108 including a leaf spring and taking the first posture and the second posture, both of which have the shape stability, by the snap-through buckling phenomenon as described above, so that the belt-like elastic body 108 takes the first posture and does not operate the operating pin 107 in the state in which the cover 104 has been closed. Therefore, since the operating pin 107 is not pressed to the abutting part 112 of the image forming apparatus body 102 side, reaction force due to pressing of the operating pin 107 to the abutting part 112 is not generated, so that the cover 104 does not receive pressure in the opening direction. Consequently, the cover 104 does not cause the fitting failure or the deformation due to the restoring force of the spring in the opening direction as with the aforementioned conventional image forming apparatus. Furthermore, it is not necessary to enhance the lock mechanism for avoiding the fitting failure or the deformation, so that there is no increase in the number of parts such as links for constituting the lock mechanism.

Figure 6:
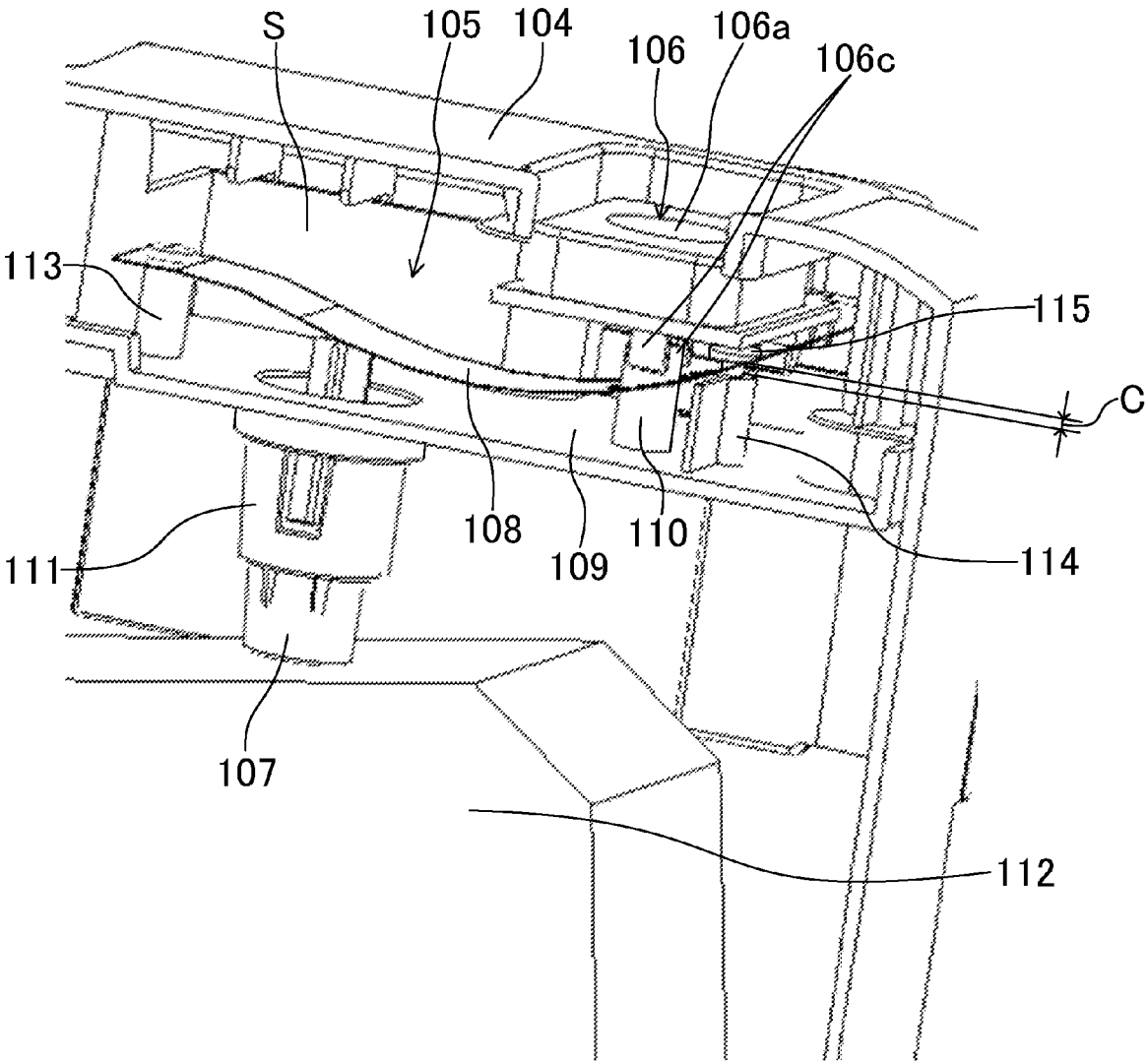
FIG. 6 is a perspective view of a cover opening and closing mechanism in a state in which a cover is opened in an image forming apparatus according to one example of an embodiment.
Figure 7:
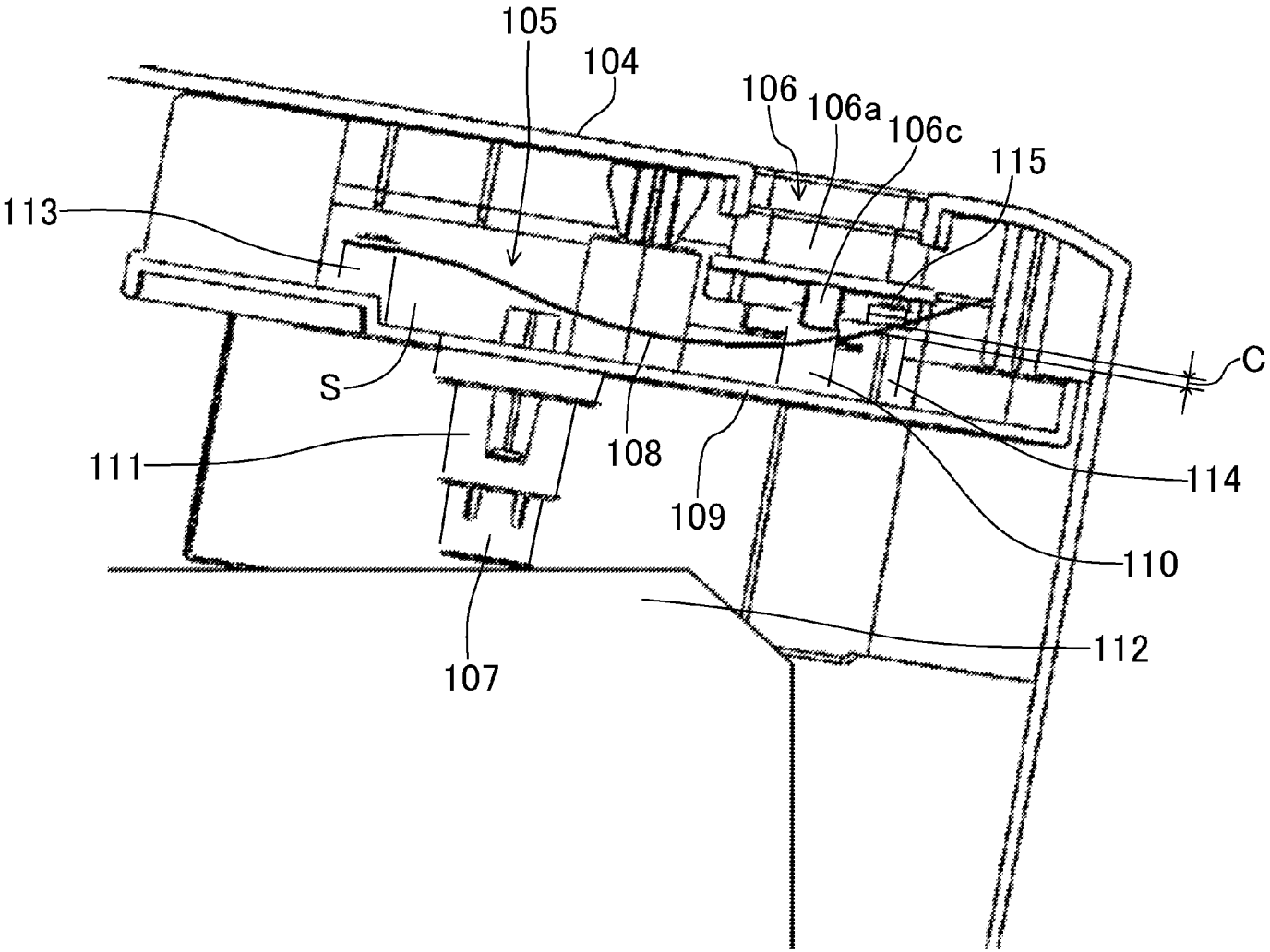
FIG. 7 is a front view of a cover opening and closing mechanism in a state in which a cover is opened in an image forming apparatus according to one example of an embodiment.
Figure 8:
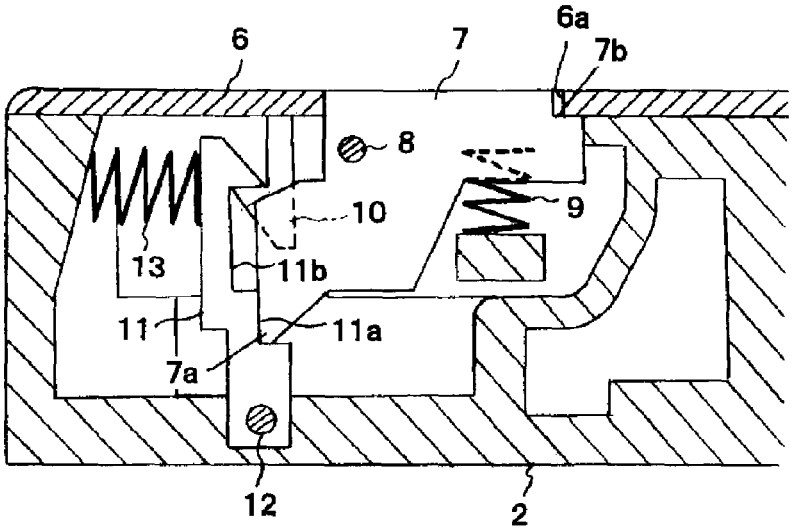
Fig.8 Prior Art
FIG. 8 is a sectional view of a cover opening and closing mechanism in a state in which a cover is closed in a conventional example.
Figure 9:
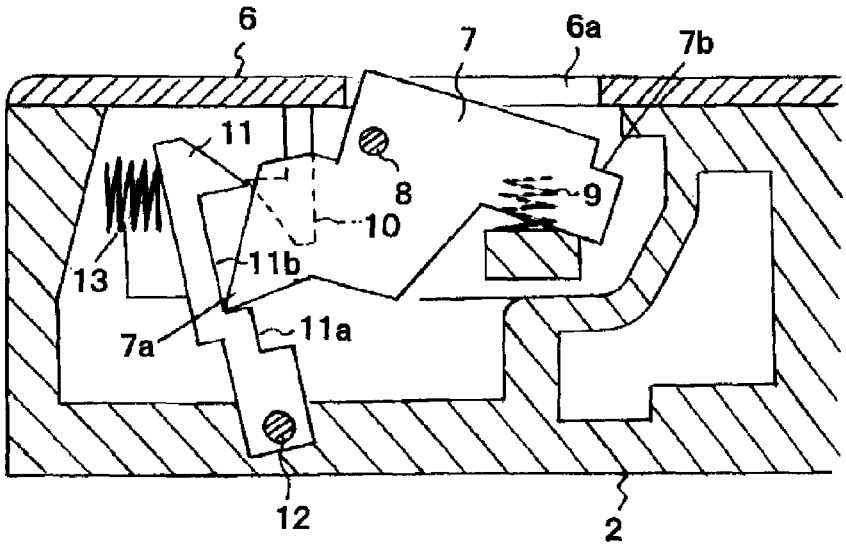
Fig.9 Prior Art
FIG. 9 is a sectional view of a cover opening and closing mechanism illustrating a state in which a cover starts to open from a closed state in a conventional example.
Figure 10:
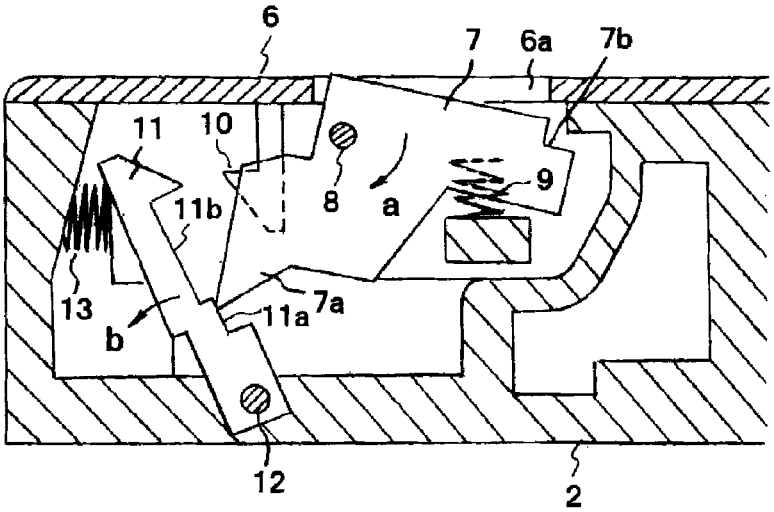
Fig.10 Prior Art
FIG. 10 is a sectional view of a cover opening and closing mechanism illustrating a state in which an opening operation is performed from the state of FIG. 9 in a conventional example.
Figure 11:
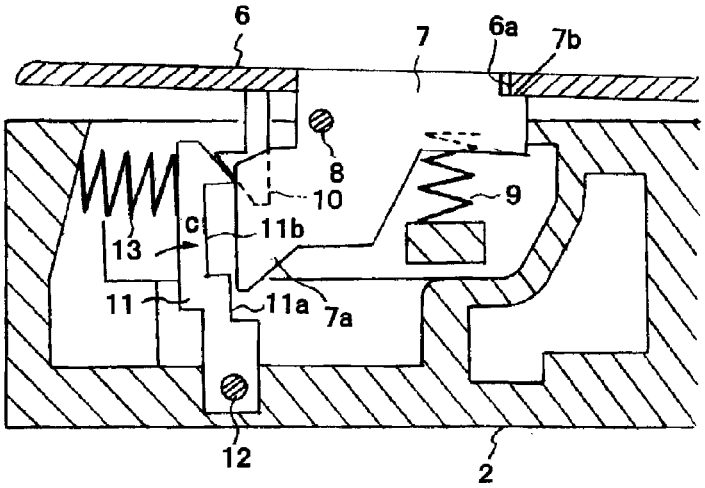
Fig.11 Prior Art
FIG. 11 is a sectional view of a cover opening and closing mechanism in a state in which a cover is opened in a conventional example.

When the cover 104 is opened from the closed state, the button 106 is pushed. Then, as illustrated in FIG. 6 and FIG. 7, by the pushing operation, the belt-like elastic body 108 takes the second posture which has the shape stability and is curved in a bow shape so as to be pushed downward by the pressing pieces 106*c* of the button 106 and to be deformed by the snap-through buckling to protrude downward. In this second posture, since the belt-like elastic body 108 pushes down the operating pin 107 to operate the operating pin 107, the lower end of the operating pin 107 is pressed to the abutting part 112 of the image forming apparatus body 102 side, so that the cover 104 is opened downward by reaction force thereof.

When the cover 104 is closed from the opened state, the cover 104 is pressed down. Then, since the operating pin 107 is pressed to the abutting part 112 of the image forming apparatus body 102 side to protrude into the cover space S, the belt-like elastic body 108 takes the first posture which has the shape stability and is curved in a bow shape so as to protrude upward, so that the button 106 is pressed up and is returned to the state of FIG. 4 and FIG. 5.

What is claimed is:

1. An image forming apparatus including a cover opening and closing mechanism, comprising:

an image forming apparatus body;

a cover provided to the image forming apparatus body so as to be openable and closable; and a cover opening and closing mechanism provided to a side of the cover, wherein the cover opening and closing mechanism includes a button, an operating pin, and a belt-like elastic body that takes a first posture and a second posture, both of which have shape stability, by a snap-through buckling phenomenon, and the belt-like elastic body takes the first posture in a state in which the cover has been closed and prevents the operating pin from being pressed to a side of the image forming apparatus body, and is pushed by a pushing operation of the button to take the second posture, operates the operating pin to be pressed to the side of the image forming apparatus body, and opens the cover by reaction force thereof.

2. The image forming apparatus including the cover opening and closing mechanism of claim 1, wherein one end of the belt-like elastic body is fixed to a first boss, the other end is locked to a retaining pin provided to a distal end of a second boss, the one end facing the other end, the retaining pin passes through the other end of the belt-like elastic body, an interval is formed between a distal end of the retaining pin and the distal end of the second boss, and the other end of the belt-like elastic body is able to move in the interval according to a deformation operation of the belt-like elastic body.

3. The image forming apparatus including the cover opening and closing mechanism of claim 1, wherein the cover opening and closing mechanism comprises a lock mechanism that locks the cover to the image forming apparatus body, and a lock state between the cover and the image forming apparatus body by the lock mechanism is released by the pushing operation of the button.

* * * * *